US010738520B2

(12) United States Patent
Cherry et al.

(10) Patent No.: US 10,738,520 B2
(45) Date of Patent: Aug. 11, 2020

(54) DOOR HINGE WITH INTEGRATED DETENT AND STOP

(71) Applicant: Ford Global Technologies, LLC, Dearborn, MI (US)

(72) Inventors: William Reese Cherry, Madison Heights, MI (US); Matthew B. Rutman, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 10 days.

(21) Appl. No.: 15/632,929

(22) Filed: Jun. 26, 2017

(65) Prior Publication Data

US 2018/0371813 A1 Dec. 27, 2018

(51) Int. Cl.

| | |
|---|---|
| ***E05D 7/10*** | (2006.01) |
| ***E05D 11/10*** | (2006.01) |
| ***E05D 5/12*** | (2006.01) |
| ***E05D 11/06*** | (2006.01) |
| *E05D 5/10* | (2006.01) |

(52) U.S. Cl.

CPC ..... *E05D 11/1071* (2013.01); *E05D 5/12* (2013.01); *E05D 7/10* (2013.01); *E05D 7/105* (2013.01); *E05D 7/1044* (2013.01); *E05D 11/06* (2013.01); *E05D 11/1085* (2013.01); *E05D 5/10* (2013.01); *E05Y 2600/12* (2013.01); *E05Y 2900/132* (2013.01); *E05Y 2900/531* (2013.01)

(58) Field of Classification Search

CPC ..... E05D 7/10; E05D 7/1044; E05D 7/105; E05D 5/12; E05D 11/1071; E05D 7/06; E05D 7/1085

USPC ..... 16/388, 362, 260, 262, 270, 254, 255, 16/256

See application file for complete search history.

(56) References Cited

U.S. PATENT DOCUMENTS

| | | | | |
|---|---|---|---|---|
| 106,315 | A * | 8/1870 | Browne | E05D 1/06 16/266 |
| 1,155,867 | A * | 10/1915 | Allgier | E05F 3/20 16/50 |
| 3,538,539 | A | 11/1970 | Allison | |
| 3,933,011 | A * | 1/1976 | DiGilio | A44C 17/0208 63/29.1 |
| 4,827,568 | A * | 5/1989 | Ramsauer | E05D 5/065 16/254 |
| 4,982,581 | A * | 1/1991 | Furuyama | A44C 17/0216 24/303 |
| 5,054,165 | A | 10/1991 | Marchione | |
| 5,481,783 | A * | 1/1996 | Liou | B60R 25/066 16/264 |
| 7,162,774 | B1 | 1/2007 | Von Resch et al. | |

(Continued)

FOREIGN PATENT DOCUMENTS

| | | | |
|---|---|---|---|
| FR | 2871503 | A1 | 12/2005 |
| JP | 2016112970 | A | 6/2016 |

*Primary Examiner* — Emily M Morgan

(74) *Attorney, Agent, or Firm* — David Coppiellie; Price Heneveld LLP

(57) ABSTRACT

A multi-position door hinge is coupled to a vehicle and includes a first hinge having a pin support, a pin, and a key. The multi-position door hinge additionally includes a second hinge having a receiving cam, a key way, and a cam groove. The multi-position door hinge is formed by coupling the first hinge to the second hinge by positioning the pin in the receiving cam with the key positioned in the key way.

19 Claims, 10 Drawing Sheets

(56) References Cited

U.S. PATENT DOCUMENTS

| | | | | |
|---|---|---|---|---|
| 7,325,276 | B2 * | 2/2008 | Kim | E05D 5/128 16/262 |
| 8,556,330 | B2 * | 10/2013 | Lazarevich | E05D 7/1005 16/262 |
| 8,739,366 | B2 | 6/2014 | Heninger | |
| 9,605,462 | B2 * | 3/2017 | Bacchetti | E05F 1/1223 |
| 2004/0025294 | A1 * | 2/2004 | Gruber | E05D 5/062 16/254 |
| 2006/0026795 | A1 * | 2/2006 | Tonelli | A45C 13/005 16/221 |
| 2008/0235910 | A1 * | 10/2008 | Umback | E05D 5/121 16/382 |
| 2014/0173852 | A1 * | 6/2014 | Heninger | E05D 5/14 16/375 |
| 2014/0252935 | A1 * | 9/2014 | McAdoo | E05D 7/105 312/326 |
| 2014/0298615 | A1 * | 10/2014 | Gouge | E05D 3/02 16/221 |

* cited by examiner

DOOR HINGE WITH INTEGRATED DETENT AND STOP

FIELD OF THE INVENTION

The present invention generally relates to a door hinge assembly for a vehicle, and more particularly, to a multi-position door hinge assembly used to easily attach and remove a vehicle door.

BACKGROUND OF THE INVENTION

Vehicle door hinges are usually equipped with a variety of different mechanisms that can open and close the door and/or retain the door in an open, closed, or partially open position. Many door hinges include the use of hardware such as nuts or bolts that make it more time intensive for a user to prepare the hinge to attach and remove the vehicle doors. Although manufacturers use a variety of different materials and designs for door hinges, the need for a door hinge that can be used to easily remove a door without removing additional hardware would be convenient and is desired by end users.

Accordingly, there is a need to develop a door hinge assembly that has the ability to retain the door in one or more open positions that can be used to easily remove the door without the need for additional hardware to be used.

SUMMARY OF THE INVENTION

According to one aspect of the present invention, a multi-position door hinge assembly for a vehicle is provided. The multi-position door hinge assembly includes a first hinge having a pin support, a pin, and a key and a second hinge having a receiving cam, a key way, and a cam groove. The first hinge is coupled to the second hinge by positioning the pin in the receiving cam with the key positioned in the key way.

Embodiments of the first aspect of the invention can include any one or a combination of the following features:

- the first hinge is coupled to a vehicle door and the second hinge is coupled to a vehicle frame;
- the first hinge is coupled to a vehicle frame and the second hinge is coupled to a vehicle door;
- the cam groove of the receiving cam includes a plurality of detents;
- the plurality of detents comprises an open position, an intermediate position, and a closed position;
- the first hinge and the second hinge each have one or more receiving members to be coupled to the vehicle;
- the multi-position door hinge assembly is coupled to an outside surface of a vehicle door and an outside surface of a vehicle frame;
- the receiving cam has a wall with the key way positioned in an outer portion of the wall;
- the first hinge is removably coupled to the second hinge;
- the first hinge and the second hinge comprise aluminum, stainless steel, titanium, magnesium, or a combination thereof;
- the multi-position door hinge assembly includes a spring, a washer, or a combination thereof positioned between the pin support and the receiving cam.

According to another aspect of the present invention, a method for reversibly coupling a door to a vehicle is provided. The method includes coupling a first hinge to the door or a vehicle frame wherein the first hinge includes a pin support, a pin, and a key, coupling a second hinge to the door or the vehicle frame, alternate the first hinge, wherein the second hinge includes a receiving cam, a key way, and a cam groove having a plurality of detents, positioning the pin of the first hinge in the receiving cam of the second hinge, and positioning the key in the key way wherein the key can be rotationally pivoted between the plurality of detents including an open position, an intermediate position, and a closed position.

Embodiments of the second aspect of the invention can include any one or a combination of the following features:

- the method includes positioning the key in the key way at a key way base; and removing the pin of the first hinge from the receiving cam of the second hinge by vertically lifting the vehicle door;
- the method includes positioning a spring, a washer, or a combination thereof between the pin support and the receiving cam.

According to yet another aspect of the present invention, a multi-position vehicle door hinge assembly is provided. The multi-position door hinge assembly includes a first hinge having a pin support, a pin, and a key and a second hinge having a receiving cam, a key way, and a cam groove. The first hinge is coupled to the second hinge by positioning the pin in the receiving cam with the key positioned in the key way.

Embodiments of the third aspect of the invention can include any one or a combination of the following features:

- the cam groove of the receiving cam includes a plurality of detents;
- the multi-position vehicle door hinge includes a spring, a washer, or a combination thereof positioned between the pin support and the receiving cam;
- the receiving cam has a wall with the key way positioned in an outer portion of the wall;
- the first hinge is removably coupled to the second hinge;
- the first hinge and the second hinge comprise aluminum, stainless steel, titanium, magnesium, or a combination thereof.

These and other aspects, objects, and features of the present invention will be understood and appreciated by those skilled in the art upon studying the following specification, claims, and appended drawings. It will also be understood that features of each embodiment disclosed herein may be used in conjunction with, or as a replacement for, features of the other embodiments.

DETAILED DESCRIPTION OF THE PREFERRED EMBODIMENTS

Figure 1:
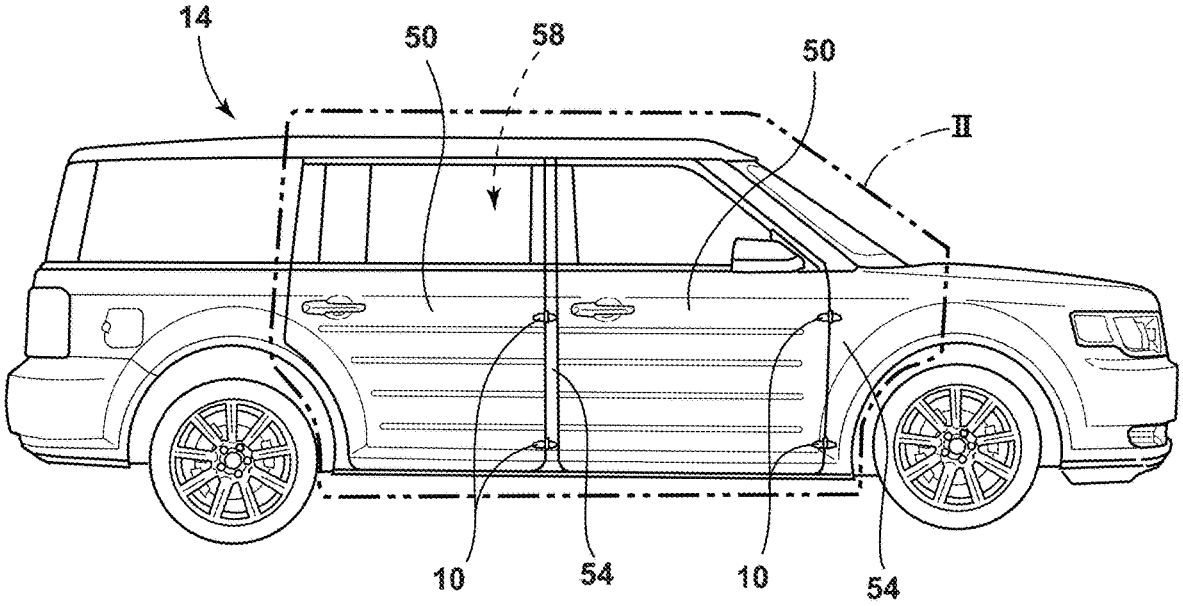
FIG. 1 is a front perspective view of a vehicle having a multi-position door hinge assembly according to the embodiments of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-11, reference numeral 10 generally designates a multi-position door hinge assembly. The multi-position door hinge assembly 10 is coupled to a vehicle 14 and includes a first hinge 18 having a pin support 22, a pin 26, and a key 30. The multi-position door hinge assembly 10 additionally includes a second hinge 34 having a receiving cam 38, a key way 42, and a cam groove 46. The multi-position door hinge assembly 10 is formed by coupling the first hinge 18 to the second hinge 34 by positioning the pin 26 in the receiving cam 38 with the key 30 positioned in the key way 42. In some aspects, the first hinge 18 may be coupled to a vehicle door 50 and the second hinge 34 may be coupled to a vehicle frame 54. In other aspects, the first hinge 18 may be coupled to the vehicle frame 54 and the second hinge 34 may be coupled to the door 54. In still other aspects, the first hinge 18 is coupled to the door 50 or the vehicle frame 54 and the second hinge 34 is coupled to the door 50 or the vehicle frame 54, alternate the first hinge 18 (the door 50 or vehicle frame 54 the first hinge is not coupled to).

Referring to FIG. 1, a wheeled automotive vehicle 14 is provided having one or more doors 50 coupled to a vehicle frame 54 with one or more multi-position door hinge assemblies 10 to enclose a passenger compartment 58. The vehicle 14 is shown as a car although the type of vehicle 14 is not meant to be limiting and the vehicle 14 could additionally be, for example, a minivan, truck, commercial vehicle, or any other wheeled motorized vehicle. Each of the doors 50 may be coupled to the vehicle frame 54 using one or more multi-position door hinge assemblies 10. In some aspects, the door 50 may be coupled to the vehicle frame 54 using two multi-position door hinge assemblies 10. In other aspects, the door 50 may be coupled to the vehicle frame 54 using three multi-position door hinge assemblies 10. Still referring to FIGS. 1-11, the multi-position door hinge assembly 10 can be rotatably coupling the vehicle door 50 to the frame 54 of the vehicle 14.

Figure 2:
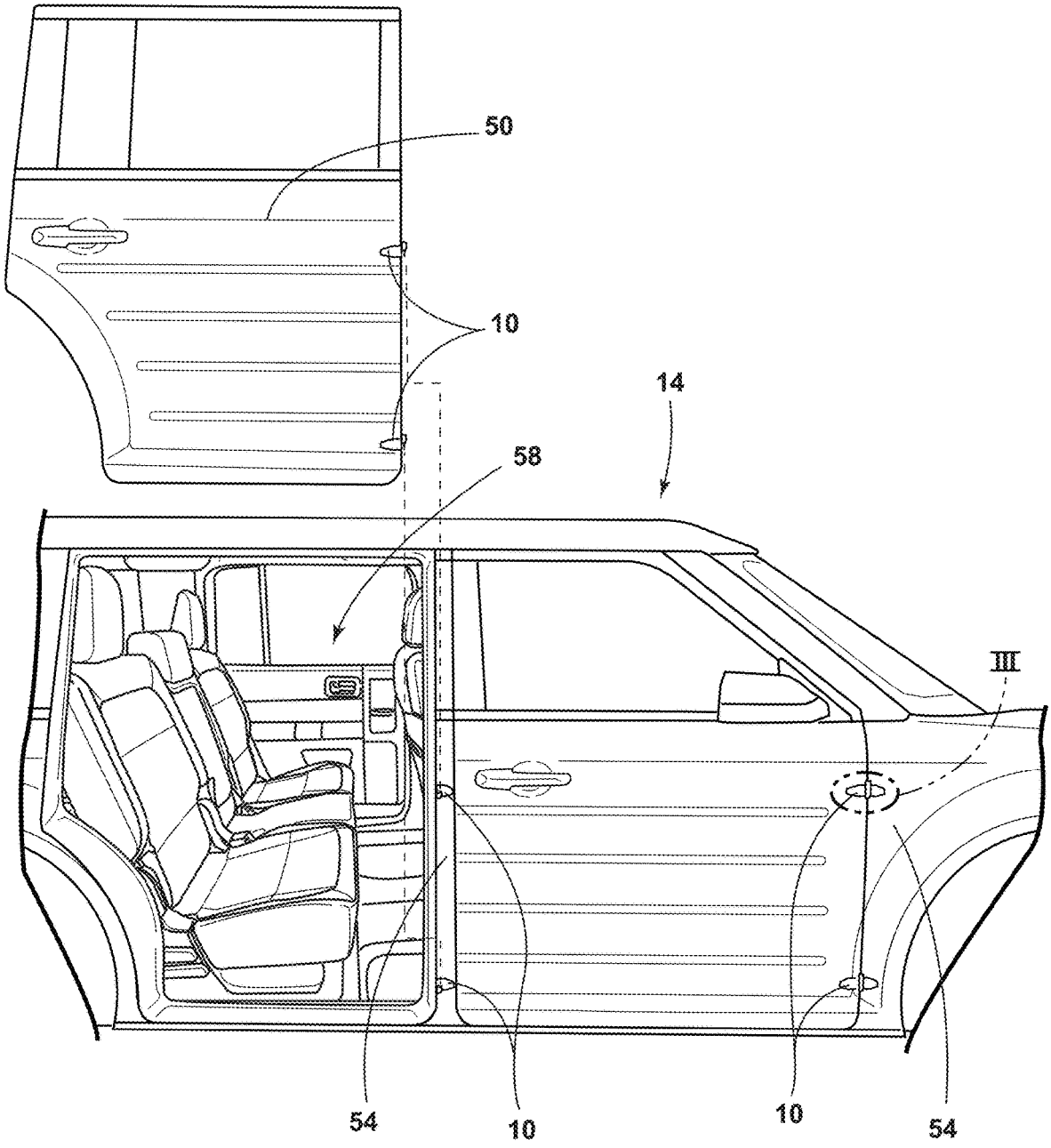
FIG. 2 is an expanded side view of the multi-position door hinge assemblies taken from the vehicle of FIG. 1 along the portion II, according to some aspects of the present disclosure.

Referring now to FIG. 2, an expanded side view of the doors 50 and the multi-position door hinge assembly 10 is provided. As shown, the door 50 may be lifted vertically from the hinge 10 to quickly and reversibly couple, decouple, remove, or detach the door 50 from the vehicle 14. The vehicle 14 is capable of operation in a "doors on" (front door) configuration and a "doors off" configuration (rear door). In the doors on configuration, the vehicle 14 includes one or more doors 50 (e.g., driver and passenger doors) positioned around the vehicle 14 enclosing the passenger compartment 58 or passenger cabin. The doors 50 are operable between a closed position 62 (FIG. 3) and an open position 66 (FIG. 4). In essence, the vehicle 14 may be operated in a doors on configuration with the doors 50 attached to the vehicle frame 54 through the multi-position door hinge assembly 10. In the doors off configuration, one or more of the doors 50 may be removed prior to operation (e.g., driving) of the vehicle 14 such that increased ventilation and/or a desired aesthetic appeal of the vehicle 14 is achieved.

Still referring to FIG. 2, the one or more doors 50 are connected to the vehicle frame 54 proximate a door sill 56. The term "vehicle frame 54", as used herein, is meant to include any portion or part of the vehicle 14, for example, the frame, body, paneling, pillar, support, etc. The door sill 56 may extend around door 50 when the doors 50 are in the closed position. The doors 50 are configured to be coupled with the vehicle frame 54 at the sill 56 such that the multi-position hinge assemblies 10 are visible while the doors 50 are in the closed position. It will be understood that in alternative examples of the vehicle 14, one or more of the multi-position hinge assemblies 10 may be substantially concealed, partially and/or fully visible while the doors 50 are in the closed position. The doors 50 are connected to the vehicle frame 54 of the vehicle 14 through one or more multi-position hinge assemblies 10. In the depicted example, the doors 50 are connected to the vehicle frame 54 through two multi-position hinge assemblies 10 (i.e., the first hinge 18 and the second hinge 34), but it will be understood that the doors 50 may be coupled to the vehicle 14 through one multi-position door hinge assembly 10 or through three or more multi-position hinge assemblies 10 per door 50.

Figure 3:
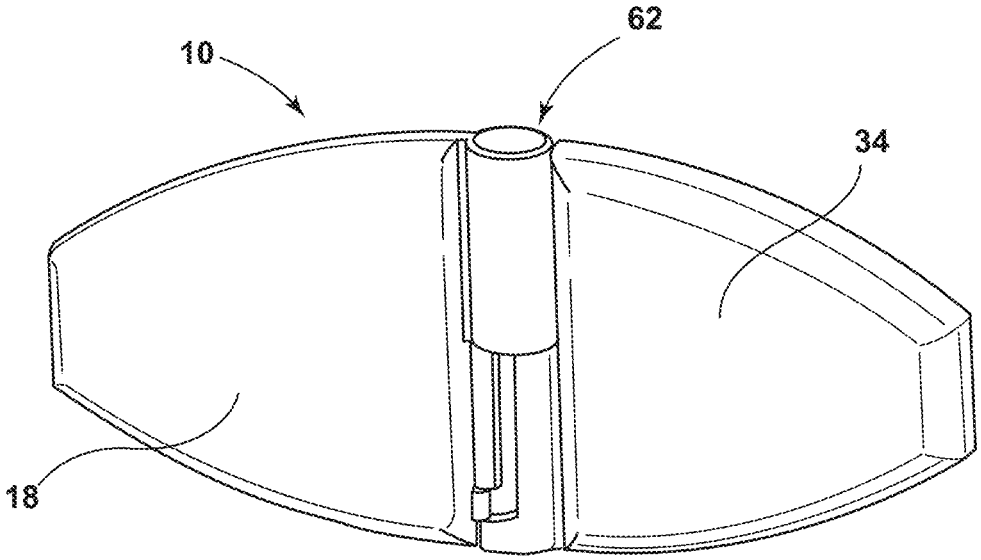
FIG. 3 is an expanded side view of the multi-position vehicle door hinge assembly in a closed position taken from the vehicle of FIG. 2 along the portion III, according to some aspects of the present disclosure.
Figure 4:
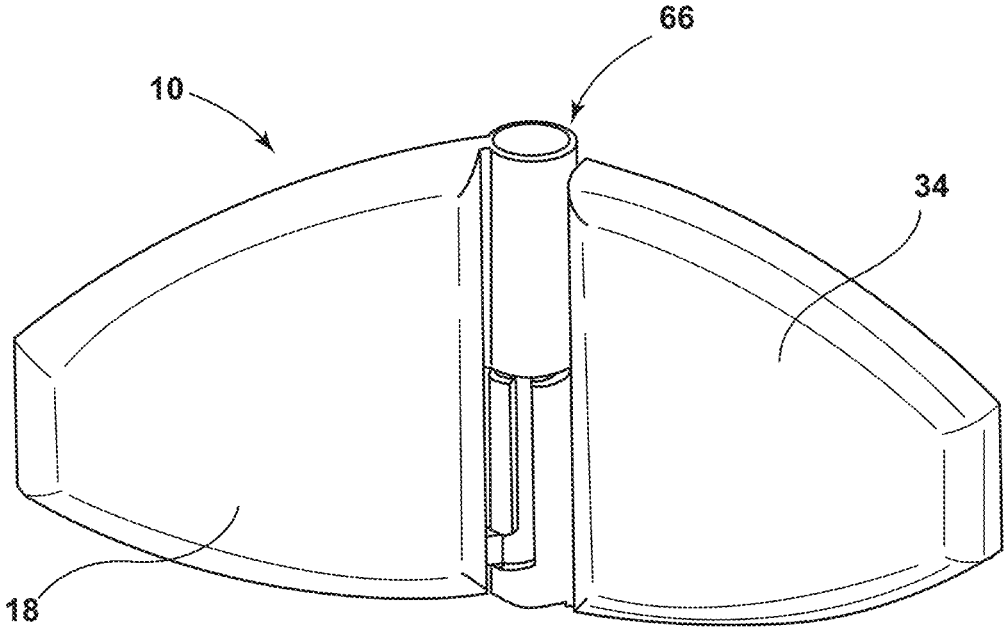
FIG. 4 is a side view of the multi-position door hinge assembly in an open position, according to some aspects of the present disclosure.

Referring now to FIGS. 3-4, the multi-position door hinge assembly 10 is shown in the closed position 62 (FIG. 3) and the open position 66 (FIG. 4). In the closed position 62, the door 50 (FIG. 2) would be closed to enclose the passenger compartment 58 (FIG. 2) while the open position 66 would have the door open for passengers to enter or exit the passenger compartment 58. The multi-position door hinge assembly 10 can be rotatably coupling the vehicle door 50 to the frame 54 of the vehicle 14. As explained above, the multi-position door hinge assemblies 10 allow the doors 50 to rotate between the open and closed positions 62, 66. In other words, the multi-position door hinge assemblies 10 rotatably couple each of the vehicle doors 50 to the vehicle frame 54. The multi-position door hinge assemblies 10 are positioned proximate the door sill 56 (FIG. 2) and are connected to the vehicle frame 54. Each of multi-position door hinge assemblies 10 may include the first hinge 18 and the second hinge 34.

Figure 5A:
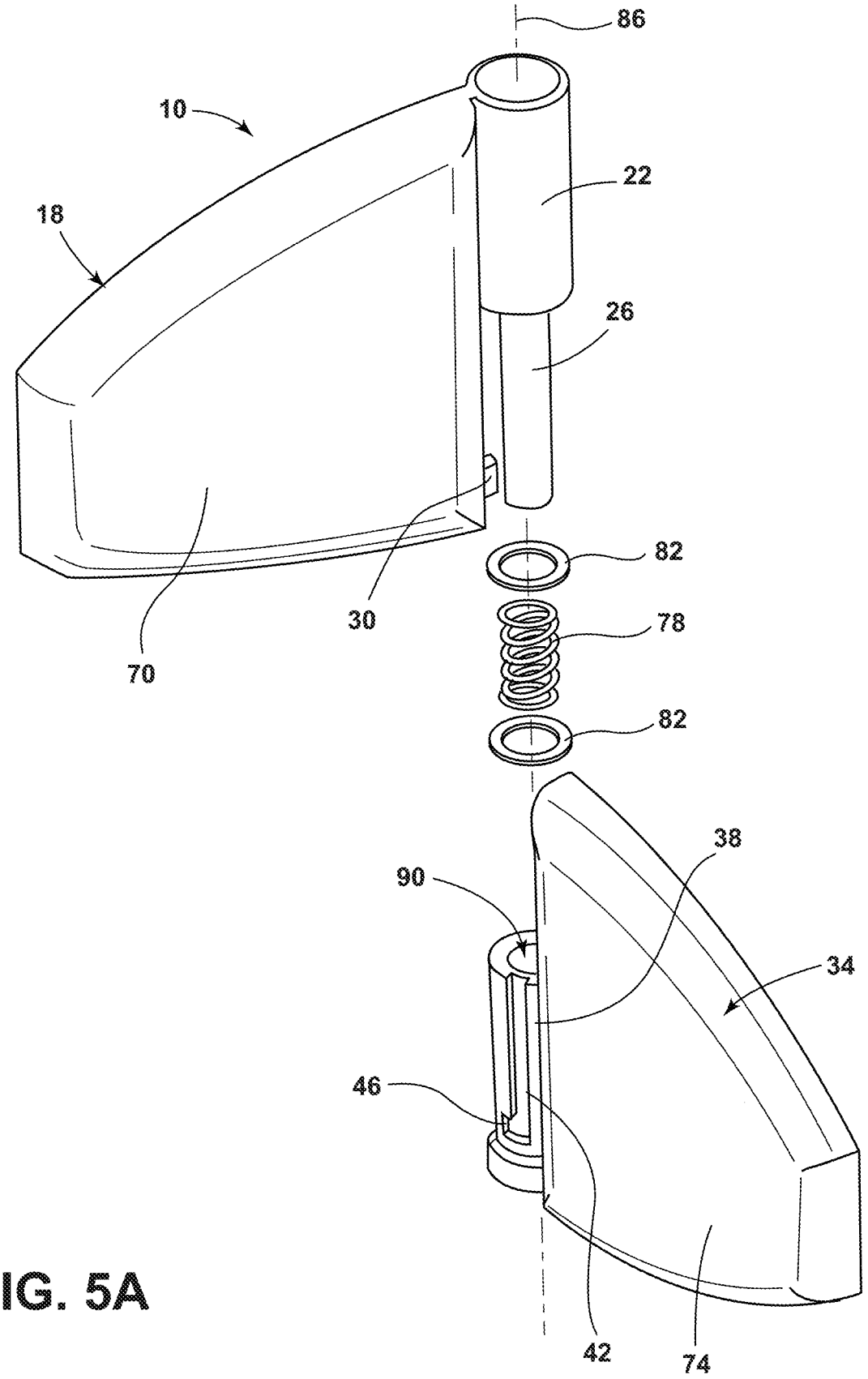
FIGS. 5A and 5B are exploded views of the multi-position door hinge assembly according to some aspects of the present disclosure

Referring now to FIG. 5A, an exploded view of the multi-position door hinge assembly 10 is provided. The multi-position door hinge assembly 10 includes both the first hinge 18 and the second hinge 34. The first hinge 18 includes the pin support 22, the pin 26, the key 30, and a first hinge body 70. The second hinge 34 includes the receiving cam 38, the key way 42, the cam groove 46, and a second hinge body 74. In some aspects, the first hinge 18 and the second hinge 34 and their respective components can be cast or made from aluminum, stainless steel, titanium, magnesium, or a combination thereof. In some aspects, the multi-position door hinge assembly 10 may include one or more springs 78, one or more washers 82, or a combination thereof. To couple the first hinge 18 to the second hinge 34, the pin 26 and the key 30 are respectfully aligned with a receiving cam opening 90 and the key way 42. Once aligned along a vertical axis 86, the pin 26 is inserted into the receiving cam opening 90 while simultaneously the key 30 is slid or positioned down through the key way 42. In some aspects, the spring 78 and/or washer 82 positioned between the pin support 22 and the receiving cam 38 may offer better alignment and/or pressure for the key 30 to be positioned through the cam groove 46.

Figure 5B:
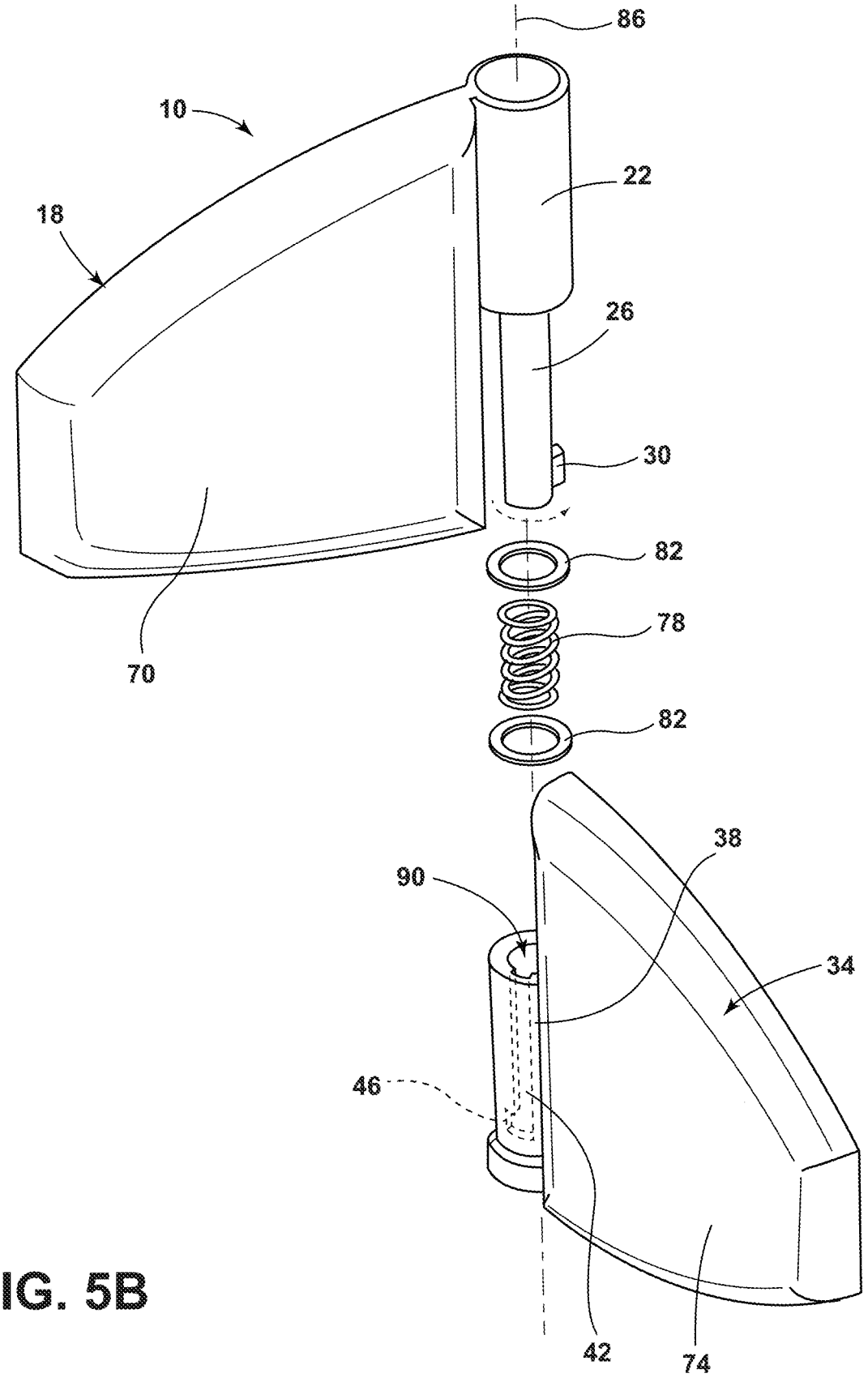
Figure 6:
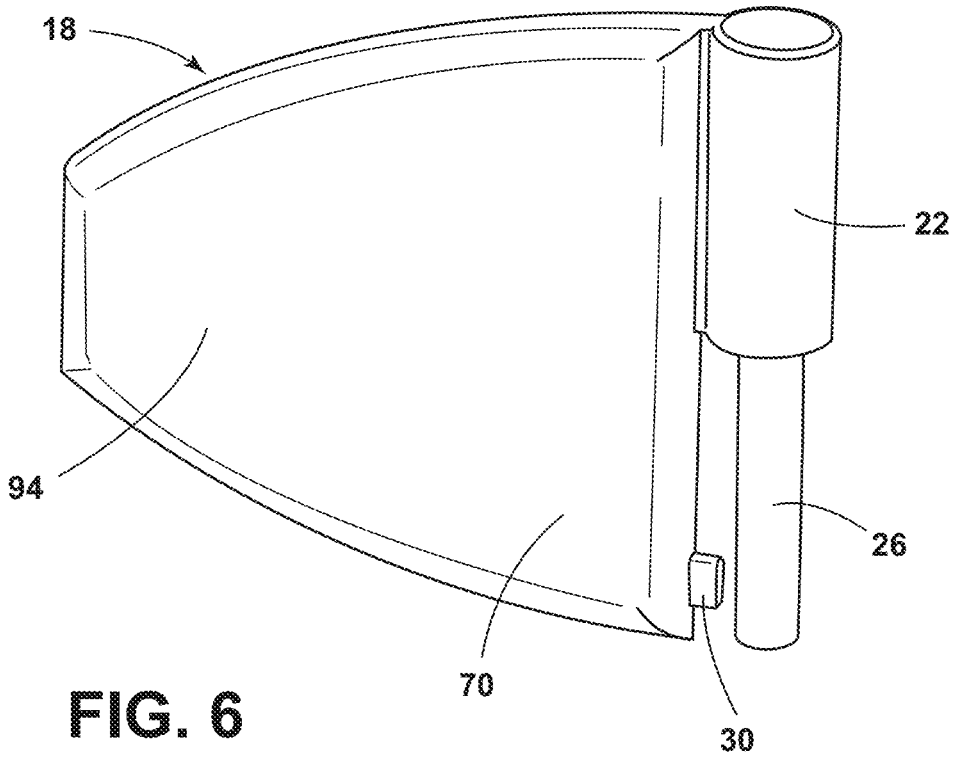
FIG. 6 is a front perspective view of a first hinge according to some aspects of the present disclosure.
Figure 7:
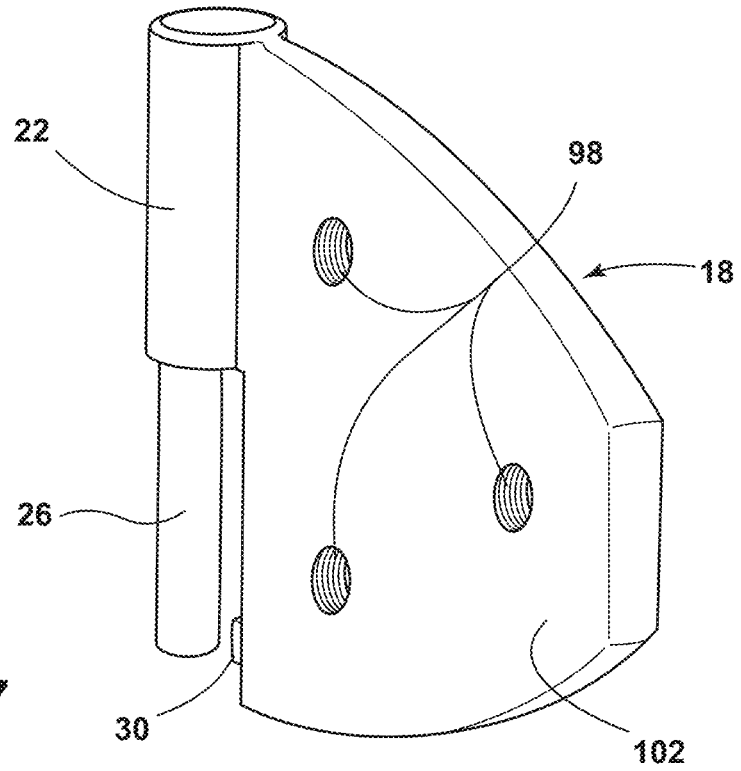
FIG. 7 is a back perspective view of the first hinge presented in FIG. 6 according to some aspects of the present disclosure.

In some aspects, as shown in FIGS. 5A and 6-7, the first hinge 18 may include the key 30 coupled to the first hinge body 70. In other aspects, as shown in FIG. 5B, the first hinge 18 may include the key 30 coupled to the pin 26 on an end of the pin 26 opposite the pin support 22. In aspects where the key 30 is coupled to the first hinge body 70, the key way 42 and cam groove 46 of the receiving cam 38 are positioned or cast in an outer wall of the receiving cam 38 as shown in FIG. 5A. In other aspects, as in FIG. 5B, where the key 30 is coupled to the pin 26 on the end of the pin 26 opposite the pin support 22, the key way 42 and cam groove 46 of the receiving cam 38 are positioned or cast in an inner wall of the receiving cam 38. Regardless if the key way 42 and cam groove 46 of the second hinge 34 are positioned or cast in the inner or outer wall of the receiving cam 38, the key 30 can be positioned appropriately on the first hinge 18 to couple and move through the key way 42 and cam groove 46 as designed for the desired application.

In some aspects, the multi-position door hinge assembly 10 may not include any springs 78 or washers 82 positioned between the first hinge 18 and second hinge 34. In some aspects, the springs 78 and/or washers 82 may be replaced by gravity where the weight of the door 50 can press and/or rotate the pin 26 along the surface of the one or more detents 114 of the cam groove 46. In other aspects, the multi-position door hinge assembly 10 may include one or more washers 82 where the weight of the door 50 can press and/or rotate the pin 26 along the surface of the one or more detents 114 of the cam groove 46.

Referring now to FIG. 6, the first hinge 18 is shown as an isolated component of the multi-position door hinge assembly 10 having the pin support 22, the pin 26, the key 30, and the first hinge body 70. The first hinge 18 additionally has an outer surface 94.

Referring now to FIG. 7, the first hinge 18 is again shown as an isolated component of the multi-position door hinge assembly 10 with an inner surface 102 provided. The inner surface 102 may have one or more receiving members 98 used to couple the multi-position door hinge assembly 10 to the vehicle door 50 (FIG. 2) and/or the vehicle frame 54 (FIG. 2). The one or more receiving members 98 may be used to couple with a rivet, screw, cotter pin, or any other type of fastener known in the art. In some aspects, the one or more receiving members 98 and/or the fasteners may not be visible from the outer surface 94. In other aspects, the one or more receiving members 98 and/or the fastener may be visible or at least partially visible from the outer surface 94.

Figure 8:
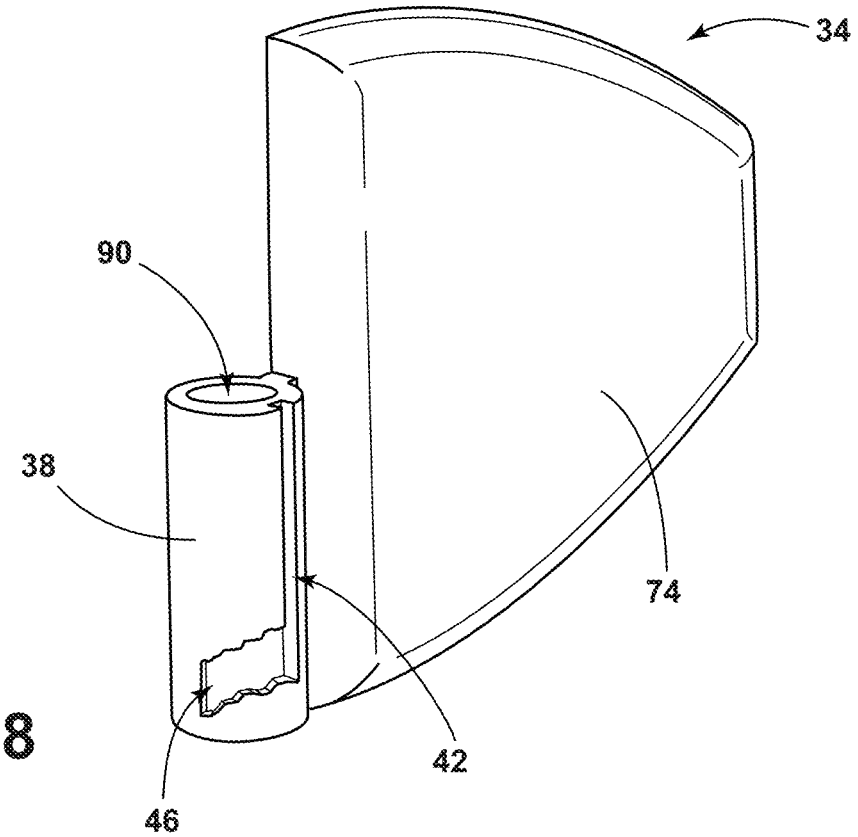
FIG. 8 is a front perspective view of a second hinge according to some aspects of the present disclosure.
Figure 9:
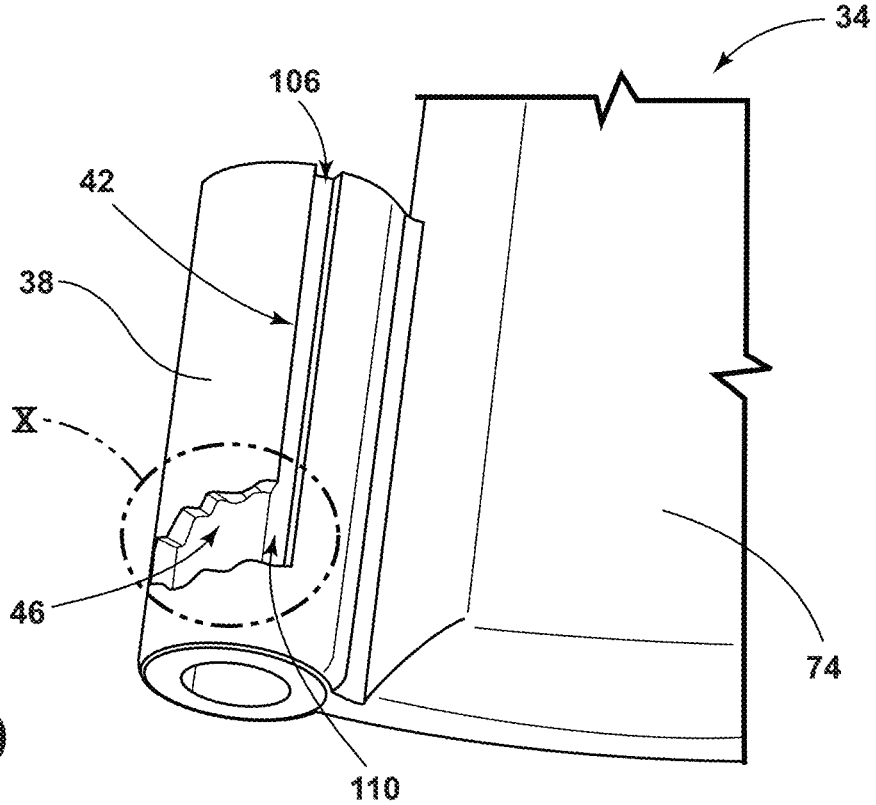
FIG. 9 is an expanded view of a receiving cam of the second hinge presented in FIG. 8 according to some aspects of the present disclosure.

Referring now to FIGS. 8-9, the second hinge 34 is shown as an isolated component of the multi-position door hinge assembly 10 having the receiving cam 38, the key way 42, the cam groove 46, and a second hinge body 74. Although not labeled, the second hinge 34 additionally includes an outer surface and an inner surface. The inner surface of the second hinge 34 may have one or more receiving members used to couple the multi-position door hinge assembly 10 to the vehicle door 50 (FIG. 2) and/or the vehicle frame 54 (FIG. 2). The one or more receiving members may be used to couple with a rivet, screw, cotter pin, or any other type of fastener known in the art. As described above, the one or more receiving members and/or the fasteners may not be visible from the outer surface or may be visible or at least partially visible from the outer surface. FIG. 9 provides an expanded view of the receiving cam 38 better displaying the key way 42 and the cam groove 46. The key way 42 includes a key way opening 106 and a key way base 110 respectively describing where the key 30 (FIG. 5A) is positioned in the key way 42. When inserting the pin 26 (FIG. 5A) into the receiving cam 38, the pin is simultaneously inserted into the key way 42 through the key way opening 106, moved through the channel formed by the key way 42, and stops at the key way base 110 where the key 30 may then be radially twisted or moved to enter into the cam groove 46 and be in contact with one or more of the detents 114.

Figure 10:
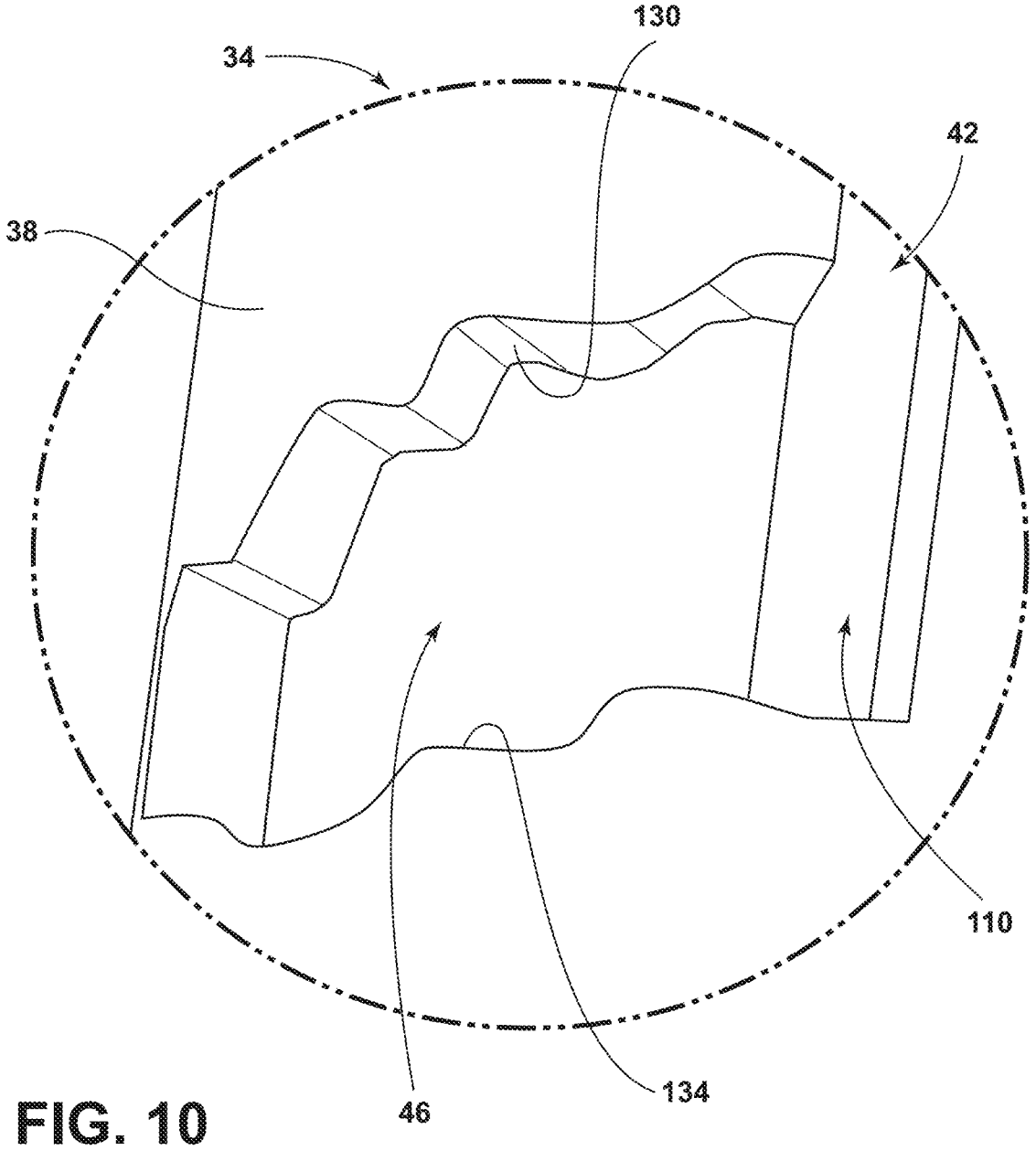
FIG. 10 is an expanded view of a cam groove of the receiving cam presented in FIG. 9 according to some aspects of the present disclosure.

Referring now to FIG. 10, an expanded view of the cam groove 46 is shown. In some aspects, the cam groove 46 may include the plurality of detents 114 that form an open position 118, an intermediate position 122, and a closed position 126 explained below. In other aspects, the cam groove 46 may include the plurality of detents 114 that form the open position 118, one or more intermediate positions 122, and the closed position 126. In certain aspects, the number of intermediate positions 122 may be one, two, three, four, or more. The number of different positions provided by the plurality of detents 114 in the cam groove 46 may be varied depending on the application or desired features of the door 50.

Figure 11:
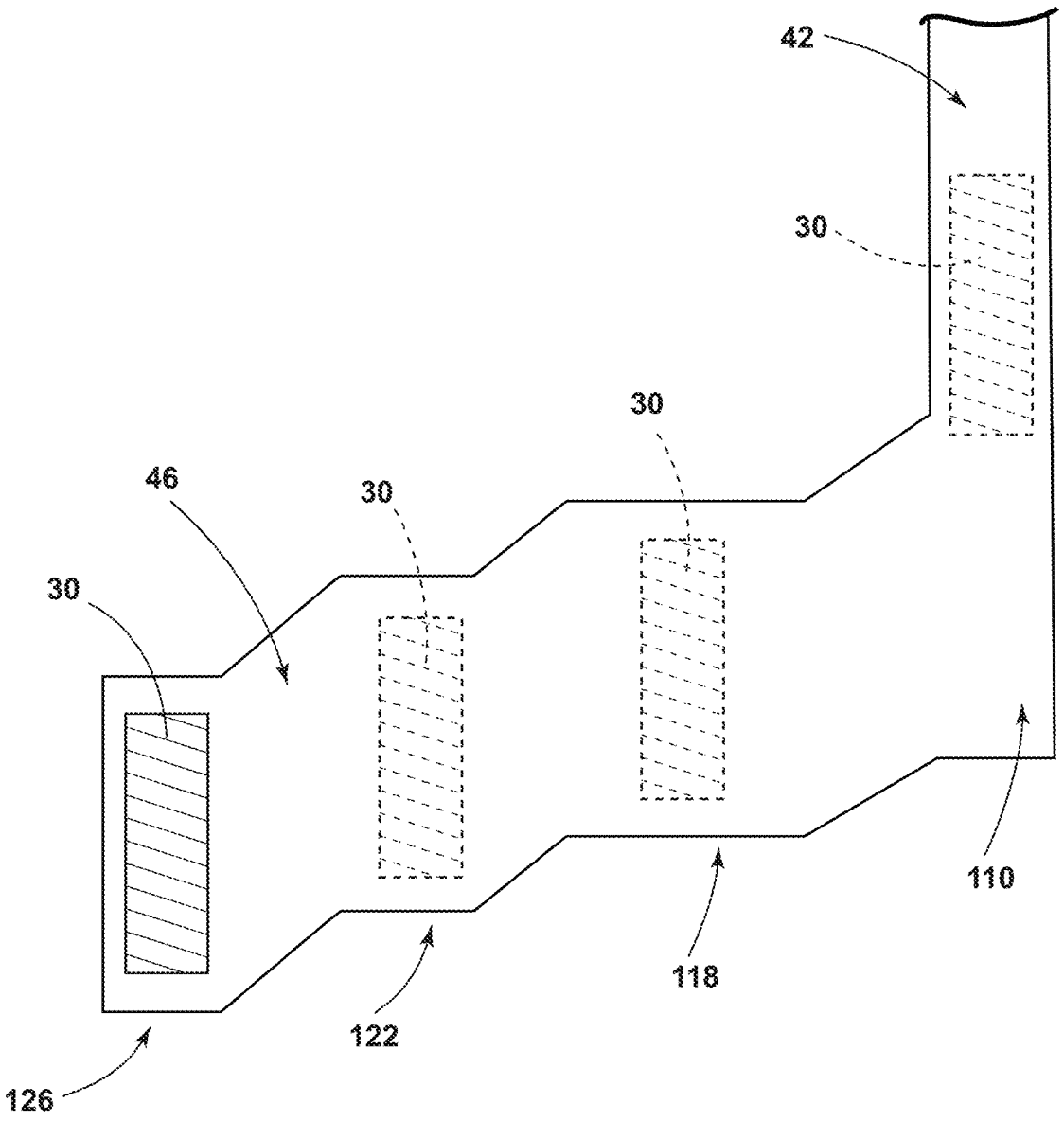
FIG. 11 is a planar view of the cam groove presented in FIG. 10 according to some aspects of the present disclosure.

FIG. 11 presents the features such as the plurality of detents 114 of the cam groove 46 in a planar view. FIG. 11 captures many example positions of the key 30 being positioned through the key way 42 and cam groove 46. For example, moving right to left, the key 30 is guided down the key way 42 to the key way base 110 where the key 30 may then be radially twisted or moved to enter into the cam groove 46. When the key 30 is positioned at the key way base 110, the door is in a fully open position 118. As the key 30 is radially twisted or moved to enter into the cam groove 46 through the pin 26 motion, the key 30 comes into contact with one or more detents 114 (ledges or surface features) that provide one or more intermediate positions 122 until the door is fully closed and the key 30 in in the closed position 126. The plurality of detents 114 may be a series of surface features making up the top and bottom surfaces of the cam groove 46 where the surface features may include a series of ledges, troughs, valleys, or other features known in the art to position the key 30 rotating through the cam groove 46. In some aspects, the plurality of detents 114 may be a series of surface features making up exclusively the bottom surface of the cam groove 46 where the surface features may include a series of ledges, troughs, valleys, or other features known in the art to position the key 30 rotating through the cam groove 46. In some aspects, to help facilitate and position the key 30 over the plurality of detents 114, the weight of the door 50 alone without the spring 78 may be used. In other aspects, the weight of the door 50 and the spring 78 may be used to help facilitate and position the key 30 over the plurality of detents 114 in the cam groove 46.

Figure 12:
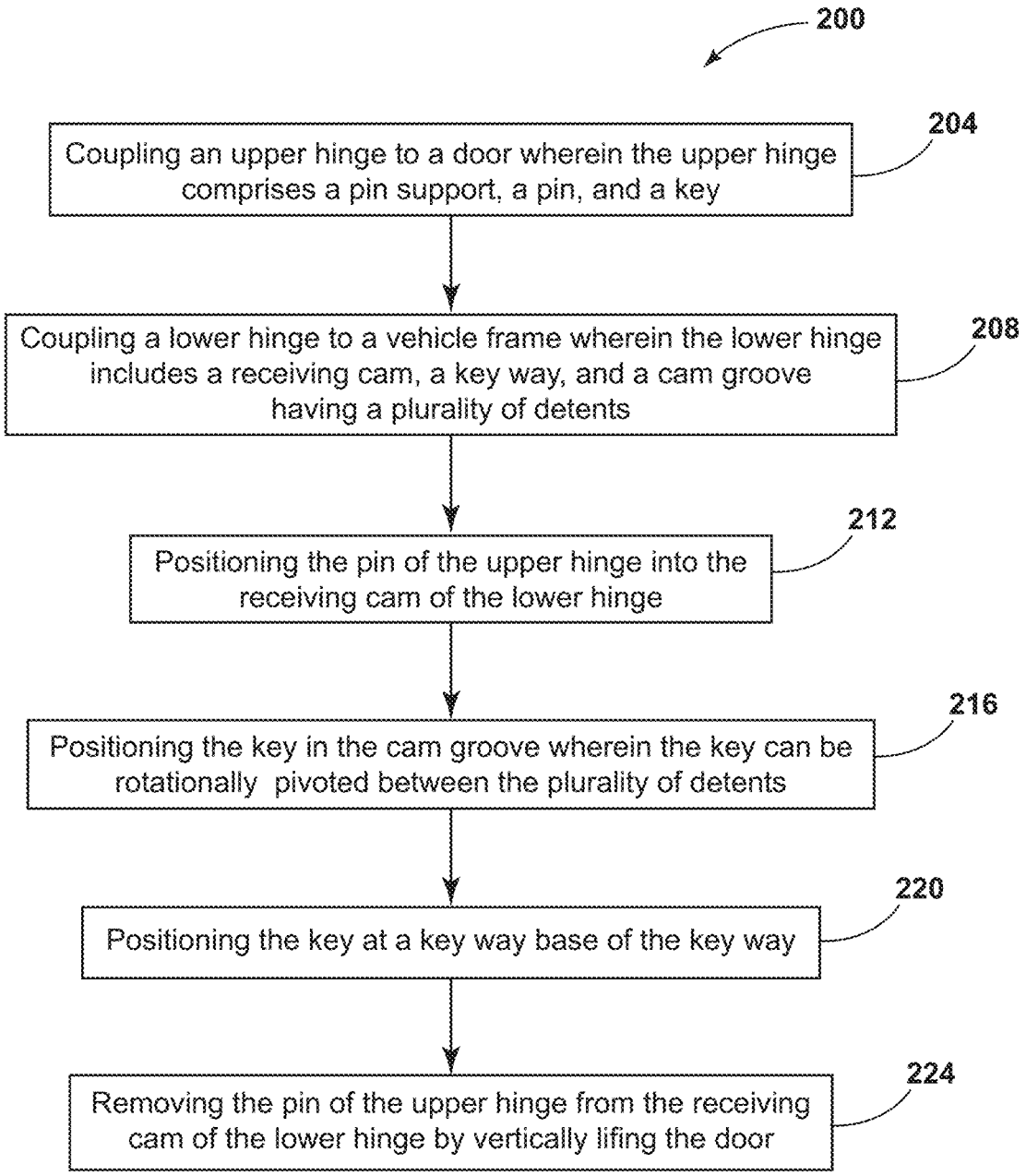
FIG. 12 is a flow diagram of a method of reversibly coupling a door to a vehicle according to some aspects of the present disclosure.

Referring now to FIG. 12, a method 200 for reversibly coupling the door 50 to the vehicle 14 using the multi-position door hinge assembly 10 provided in FIGS. 1-11 is shown. The method 200 may begin with a step 204 that includes providing the first hinge 18 to include the pin support 22, the pin 26, and the key 30. In some aspects, the first hinge 18 may be coupled to the vehicle door 50 and in other aspects the first hinge 18 may be coupled to the vehicle frame 54. In some aspects, the step 204 may include coupling the first hinge 18 to the door 50 or the vehicle frame 54 wherein the first hinge 18 includes the pin support 22, the pin 26, and the key 30.

Next, a step 208 of providing the second hinge 34 to include the receiving cam 38, the key way 42, and the cam groove 46 having the plurality of detents 114. In some aspects, the second hinge 34 may be coupled to the vehicle door 50 and in other aspects the second hinge 34 may be coupled to the vehicle frame 54. In some aspects, the step 208 may include coupling the second hinge 34 to the door 50 or the vehicle frame 54, alternate the first hinge 18, wherein the second hinge 34 includes the receiving cam 38, the key way 42, and the cam groove 46 having the plurality of detents 114.

Next, a step 212 of positioning the pin 26 of the first hinge 18 into the receiving cam 38 of the second hinge 34. In other aspects, step 212 includes positioning the pin 26 of the second hinge 34 into the receiving cam 38 of the first hinge 18. In still other aspects, the step 212 includes positioning the pin 26 of the first hinge 18 in the receiving cam 38 of the second hinge 34.

Next, a step 216 of positioning the key 30 in the key way 42 wherein the key 30 may be rotationally pivoted between the plurality of detents 114 including the open position 118, the intermediate position 122, and the closed position 126. In some aspects, the step 216 includes positioning the key 30 in the cam groove 46 of the key way 42 wherein the key 30 can be rotationally pivoted between the plurality of detents 114 including the open position 118, one or more intermediate position 122, and the closed position 126.

Next, a step 220 of positioning the key 30 in the key way 42 at the key way base 110 to remove the door 50 from the vehicle frame 54. In some aspects, the step 220 includes positioning the key 30 in the key way 42 at the key way base 100.

Next, a step 224 of removing the pin 26 of the first hinge 18 from the receiving cam 38 of the second hinge 34 by vertically lifting the vehicle door 50 away from the vehicle frame 54. In some aspects, the step 224 includes removing the pin 26 of the first hinge 18 from the receiving cam 38 of the second hinge 34 by vertically lifting the door 50.

It is understood that the descriptions outlining and teaching the multi-position door hinge assembly 10 previously discussed, which can be used in any combination, apply equally well to the method 200 for reversibly coupling the door 50 to the vehicle 14 using the multi-position door hinge assembly 10.

Use of the present disclosure may offer a variety of advantages. First, the multi-position door hinge assembly 10 may allow the one or more doors 50 to be removed from the vehicle 14 without removing additional hardware like nuts or bolts. Second, without any fasteners or hardware to be removed, a user can remove the doors 50 from the vehicle easier and faster than other hinge designs known and used in the art. Third, the key 30 can slide or be positioned in the cam groove 46 to keep the door 50 secured in one or more positions less than fully open. Fourth, the cam groove 46 is shaped so the key 30 can be pressed into or positioned over the plurality of detents 114 which can hold the door 50 in place at one or more open positions. Fifth, the ends of the cam groove 46 can act as a stop for the door 50, limiting the fully open and fully closed position of the door 50. Sixth, positioning the key 30 in the cam groove 46 can secure the door 50 to restrict vertical movement.

It will be understood by one having ordinary skill in the art that construction of the described device and other components may not be limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A vehicle door hinge assembly comprising:

a first hinge body having a pin support coupled to a top portion of the first hinge body, wherein a pin extends from the pin support and defines a key at an opposing end thereof; and a second hinge body having a receiving cam, a key way, and a cam groove, wherein the key way and the cam groove are defined by an inner wall of the receiving cam, and wherein the cam groove defines a plurality of parallel ledges spaced-apart from one another coupled together via a plurality of parallel obliquely-oriented surfaces.

2. The vehicle door hinge assembly of claim 1, further comprising:

a spring, a washer, or a combination thereof positioned between the pin support and the receiving cam.

3. The vehicle multi-position door hinge assembly of claim 1, wherein the first hinge body and the second hinge body comprise aluminum, stainless steel, titanium, magnesium, or a combination thereof.

4. The vehicle door hinge assembly of claim 1, wherein the cam groove of the receiving cam includes a plurality of detents.

5. The vehicle door hinge assembly of claim 4, wherein the plurality of detents are defined by a top surface and a bottom surface of the cam groove.

6. The vehicle door hinge assembly of claim 4, wherein the plurality of detents provide for said vehicle door hinge assembly to be operable between an opened door position, a closed door position, and more than one intermediate door position.

7. A multi-position vehicle door hinge assembly, comprising:

a first hinge body having a pin and a key; and a second hinge body having a receiving cam, a key way, and a cam groove, wherein the first and second hinge bodies cooperate to be operable between an opened door position and a closed door position;

wherein a bottom surface of the cam groove defines a plurality of descending ledges, wherein a first ledge of the plurality of descending ledges is defined by a key way base and cooperates with the key to provide for the opened door position, a final ledge of the plurality of descending ledges provides for the closed door position, and intermediate ledges positioned therebetween provide for intermediate door positions, wherein each ledge of the plurality of descending ledges operates to retain the first and second hinge bodies in one of the opened, closed, or intermediate door positions, respectively, and wherein the plurality of descending ledges are planar surfaces coupled to adjacent ledges of the plurality of descending ledges by obliquely-oriented surfaces, wherein the ledges of the plurality of descending ledges are parallel to one another, and wherein the obliquely-oriented surfaces are parallel to one another.

8. The multi-position vehicle door hinge assembly of claim 7, wherein the first hinge body is coupled to a vehicle door and the second hinge body is coupled to a vehicle frame.

9. The multi-position vehicle door hinge assembly of claim 7, wherein the first hinge is coupled to a vehicle frame and the second hinge body is coupled to a vehicle door.

10. The multi-position vehicle door hinge assembly of claim 7, wherein the plurality of detents provide for more than one intermediate door position.

11. The multi-position vehicle door hinge assembly of claim 7, wherein the first hinge and the second hinge body each have one or more receiving members for coupling the first and second hinge bodies to the vehicle.

12. The multi-position vehicle door hinge assembly of claim 7, wherein the multi-position door hinge assembly is coupled to an outside surface of a vehicle door and an outside surface of a vehicle frame.

13. The multi-position vehicle door hinge assembly of claim 7, wherein the receiving cam has a wall with the key way positioned in an outer portion of the wall.

14. The multi-position vehicle door hinge assembly of claim 7, wherein the first hinge body and the second hinge body comprise aluminum, stainless steel, titanium, magnesium, or a combination thereof.

15. The multi-position vehicle door hinge assembly of claim 7, further comprising:

a spring, a washer, or a combination thereof positioned between the pin support and the receiving cam.

16. The multi-position vehicle door hinge assembly of claim 7, wherein a top surface of the cam groove defines a plurality of ledges configured to correspond with the plurality of descending ledges defined by the bottom surface of the cam groove.

17. A method for reversibly coupling a door to a vehicle, the method comprising:

coupling a first hinge body to the door or a vehicle frame, wherein the first hinge body comprises a pin support, a pin, and a key;

coupling a second hinge body to the door or the vehicle frame, alternate the first hinge body, wherein the second hinge body comprises a receiving cam, a key way, and a cam groove having a bottom surface including a plurality of detents and a plurality of obliquely-oriented surfaces between adjacent detents of the plurality of detents, the plurality of detents and the plurality of obliquely-oriented surfaces extending across the bottom surface;

positioning the pin of the first hinge body into the receiving cam of the second hinge;

rotating the first hinge body such that the key is positioned in the cam groove; and rotating the key along the cam groove;

sliding the key along the plurality of detents and the plurality of obliquely-oriented surfaces defined on the bottom surface of the cam groove to move the first and second hinge bodies between an opened door position, an intermediate door position, and a closed door position.

18. The method of claim 17, further comprising:

positioning the key in the key way at a key way base; and removing the pin of the first hinge body from the receiving cam of the second hinge body by vertically lifting the door.

19. The method of claim 17, further comprising:

positioning a spring, a washer, or a combination thereof between the pin support and the receiving cam.

* * * * *